US010961972B2

(12) United States Patent
Lorenz et al.

(10) Patent No.: US 10,961,972 B2
(45) Date of Patent: Mar. 30, 2021

(54) METHOD AND APPARATUS TO CONTROL AN IGNITION SYSTEM

(71) Applicant: Delphi Automotive Systems Luxembourg SA, Bascharage (LU)

(72) Inventors: Frank Lorenz, Trier (DE); Marco Loenarz, Esch Alzette (LU); Peter Weyand, Bertrange (LU)

(73) Assignee: DELPHI AUTOMOTIVE SYSTEMS LUXEMBOURG S.A., Luxembourg (LU)

( * ) Notice: Subject to any disclaimer, the term of this patent is extended or adjusted under 35 U.S.C. 154(b) by 424 days.

(21) Appl. No.: 15/036,434

(22) PCT Filed: Nov. 11, 2014

(86) PCT No.: PCT/EP2014/074237
§ 371 (c)(1),
(2) Date: May 13, 2016

(87) PCT Pub. No.: WO2015/071245
PCT Pub. Date: May 21, 2015

(65) Prior Publication Data

US 2016/0298593 A1 Oct. 13, 2016

(30) Foreign Application Priority Data

Nov. 14, 2013 (EP) ..... 13192916

(51) Int. Cl.
*F02P 15/10* (2006.01)
*F02D 41/00* (2006.01)
(Continued)

(52) U.S. Cl.
CPC ..... *F02P 15/10* (2013.01); *F02D 41/009* (2013.01); *F02P 3/0442* (2013.01); *F02P 3/053* (2013.01); *F02P 3/0554* (2013.01); *F02P 17/12* (2013.01)

(58) Field of Classification Search
CPC ..... Y02T 10/36; Y02T 10/46; Y02T 10/123; Y02T 10/18; Y02T 10/144; Y02T 10/47;
(Continued)

(56) References Cited

U.S. PATENT DOCUMENTS

2002/0066444 A1* 6/2002 Ikeda ..... F02P 3/0892 123/606
2010/0052538 A1* 3/2010 Tanaka ..... H05B 41/2928 315/82
(Continued)

FOREIGN PATENT DOCUMENTS

DE 102007034390 A1 1/2009
DE 102007034399 A1 1/2009
(Continued)

OTHER PUBLICATIONS

Author:Lorenz, Frank, Publisher: EP2325476A1, Title: Couped Multi-charge ignition system with an intelligent controlling circuit, Date:May 25, 2011.*
(Continued)

*Primary Examiner* — Wei (Victor) Y Chan
(74) *Attorney, Agent, or Firm* — Joshua M. Haines

(57) ABSTRACT

An ignition system including a spark plug control unit adapted to control at least two coil stages to provide a current to a spark plug, including two stages including a first transformer including a first primary winding inductively coupled to a first secondary winding; a second transformer including a second primary winding inductively coupled to a second secondary winding; the control unit enabled to
(Continued)

simultaneously switch on and off two corresponding switches to maintain a continuous ignition fire, and includes a step-down converter stage with a switch and a diode. The method includes i) switching off the switch; and ii) toggling the two corresponding switches.

11 Claims, 11 Drawing Sheets

(51) Int. Cl.

| | |
|---|---|
| ***F02P 3/04*** | (2006.01) |
| ***F02P 3/05*** | (2006.01) |
| ***F02P 3/055*** | (2006.01) |
| ***F02P 17/12*** | (2006.01) |

(58) Field of Classification Search
CPC ..... Y02T 10/42; Y02T 10/44; Y02T 10/121; Y02T 10/146; Y02T 10/22; Y02T 10/32; Y02T 10/126; Y02T 10/128; Y02T 10/142; Y02T 10/16
USPC ..... 315/82, 287; 123/606, 406.12; 361/263
See application file for complete search history.

(56) References Cited

U.S. PATENT DOCUMENTS

| | | | | |
|---|---|---|---|---|
| 2011/0041804 | A1* | 2/2011 | Petruska ..... | F02P 3/01 123/406.12 |
| 2011/0255208 | A1* | 10/2011 | Petruska ..... | F02P 3/01 361/263 |
| 2012/0312285 | A1 | 12/2012 | Bolz et al. | |
| 2013/0152910 | A1 | 6/2013 | Minoya et al. | |
| 2013/0263835 | A1 | 10/2013 | Eisen et al. | |
| 2015/0034059 | A1 | 2/2015 | Heise et al. | |

FOREIGN PATENT DOCUMENTS

| | | | |
|---|---|---|---|
| DE | 102008038513 | A1 | 2/2010 |
| DE | 102012106207 | B3 | 5/2013 |
| EP | 2325476 | A1 | 5/2011 |
| EP | 2654207 | A2 | 10/2013 |
| JP | 2008-291721 | A | 12/2008 |

OTHER PUBLICATIONS

Author: Lorenz, Frank; Title: Coupled multi-charge ignition system with an intelligent controlling circuit; date:May 25, 2011; Publisher: EP2 325 476 A1.*

PCT/EP2014/074235 International Search Report dated Jan. 26, 2015.

* cited by examiner

METHOD AND APPARATUS TO CONTROL AN IGNITION SYSTEM

CROSS REFERENCE TO RELATED APPLICATIONS

This application is a national stage application under 35 USC 371 of PCT Application No. PCT/EP2014/074237 having an international filing date of Nov. 11, 2014, which is designated in the United States and which claimed the benefit of EP Patent Application No. 13192916.8 filed on Nov. 14, 2013, the entire disclosures of each are hereby incorporated by reference in their entirety.

TECHNICAL FIELD

The present invention relates to an ignition system and method of controlling spark plugs. It has particular but not exclusive application to systems which are adapted to provide a continuous spark, such as a multi-spark plug ignition system.

BACKGROUND OF THE INVENTION

Ignition engines that use very lean air-fuel mixtures have been developed, that is, having a higher air composition to reduce fuel consumption and emissions. In order to provide a safe ignition it is necessary to have a high energy ignition source. Prior art systems generally use large, high energy, single spark ignition coils, which have a limited spark duration and energy output. To overcome this limitation and also to reduce the size of the ignition system multi-charge ignition systems have been developed. Multi-charge systems produce a fast sequence of individual sparks, so that the output is a long quasi-continuous spark. Multi-charge ignition methods have the disadvantage that the spark is interrupted during the recharge periods, which has negative effects, particularly noticeable when high turbulences are present in the combustion chamber. For example this can lead to misfire, resulting in higher fuel consumption and higher emissions.

An improved multi-charge system is described in European Patent EP2325476 which discloses a multi-charge ignition system without these negative effects and, at least partly, producing a continuous ignition spark over a wide area of burn voltage, delivering an adjustable energy to the spark plug and providing with a burning time of the ignition fire that can be chosen freely.

However there are still various problems with such systems. It is not possible to control the secondary current, which results in a high spark plug wear as well as a large amount of wasted energy which is not required for combustion. Furthermore at the end of the ignition cycle a high secondary current peak can be generated, which results in a high spark plug wear.

Furthermore in such systems, the PWM-signal of the step-down-converter stage is adapted to a fixed value, which results in a non-stable primary current under various conditions.

Aspects of the invention are provided as stated in the claims.

SUMMARY OF THE INVENTION

A method is provided for controlling an ignition system which includes a spark plug control unit adapted to control at least two coil stages so as to successively energise and de-energise the at least two coil stages to provide a current to a spark plug, including two stages comprising a first transformer including a first primary winding inductively coupled to a first secondary winding; a second transformer including a second primary winding inductively coupled to a second secondary winding; the spark plug control unit enabled to simultaneously energize and deenergize the first primary winding and the second primary winding by simultaneously switching on and off two corresponding switches to sequentially energize and de-energize the first primary winding and the second primary winding by sequentially switching on and off both of the two corresponding switches to maintain a continuous ignition fire, and includes a step-down converter stage located between the spark plug control unit and the at least two coil stages, the step-down converter including a switch and a diode, the spark plug control unit being enabled to switch off the switch, wherein the method provides control to limit a secondary current peak at the end of a Coupled Multi-Charge period. The method includes, at the end of the Coupled Multi-Charge period, i) switching off the switch; and ii) toggling the two corresponding switches.

BRIEF DESCRIPTION OF THE DRAWINGS

The invention will now be described by way of example and with reference to the following figures of which.

Figure 1:
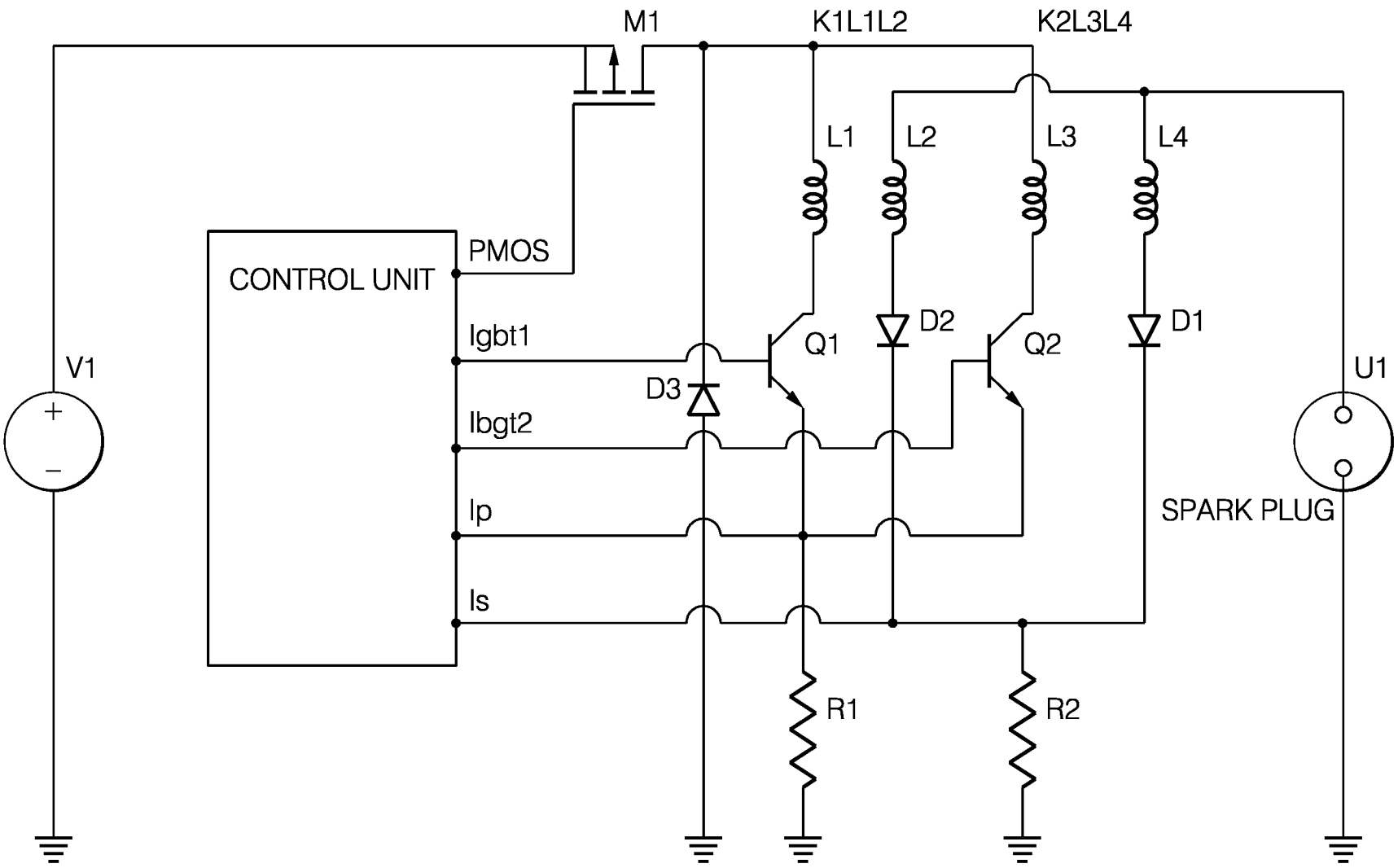
FIG. 1 is a schematic diagram of an ignition system to which aspects of the invention can be applied.

Hereinafter the following abbreviations are used:

L1—Primary inductance coil 1
L2—Secondary inductance coil 1
L3—Primary inductance coil 2
L4—Secondary inductance coil 2
K1—Magnetic coupling factor coil 1
K2—Magnetic coupling factor coil 2
R1—Primary current shunt resistor
R2—Primary current shunt resistor
Q1—IGBT for coil stage 1
Q2—IGBT for coil stage 2
ECU—Engine Control Unit
CU—Control Unit of the ignition coil
CMC—Coupled MultiCharge Ignition
Ipth—Primary current switching threshold in CMC
Isth—Secondary current switching threshold in CMC Ipmax—Maximum primary current peak after initial charge Ipthmax—Maximum primary current switching threshold in step-down-operation Ipthmin—Minimum primary current switching threshold in step-down-operation Isamp—Secondary current amplitude during CMC-operation Isamprd—Secondary current amplitude during the down ramping cycle after CMC-operation FIG. 1 shows the circuitry of a prior art coupled-multi-charge ignition system for producing a continuous ignition spark over a wide area of burn voltage servicing a single set of gapped electrodes in a spark plug such as might be associated with a single combustion cylinder of an internal combustion engine (not shown). The CMC system uses fast charging ignition coils (L1-L4), including primary windings, L1, L2 to generate the required high DC-voltage. The voltage and wound on a common core K1 forming a first transformer and secondary windings L3, L4 wound on another common core K2 are forming a second transformer. The two coil ends of the first and second primary windings L1, L3 may be alternately switched to a common ground such as a chassis ground of an automobile by electrical switches Q1, Q2. These switches Q1, Q2 are preferably Insulated Gate Bipolar Transistors. Resistor R1 for measuring the primary current Ip that flows from the primary side is connected between the switches Q1, Q2 and ground, while resistor R2 for measuring the secondary current Is that flows from the secondary side is connected between the diodes D1, D2 and ground.

The low-voltage ends of the secondary windings L2, L4 may be coupled to a common ground or chassis ground of an automobile through high-voltages diodes D1, D2. The high-voltage ends of the secondary ignition windings L2, L4 are coupled to one electrode of a gapped pair of electrodes in a spark plug through conventional means. The other electrode of the spark plug is also coupled to a common ground, conventionally by way of threaded engagement of the spark plug to the engine block. The primary windings L1, L3 are connected to a common energizing potential which in the present embodiment is assumed to correspond to conventional automotive system voltage in a nominal 12V automotive electrical system and is in the figure the positive voltage of battery. The charge current can be supervised by an electronic control circuit that controls the state of the switches Q1, Q2. The control circuit is for example responsive to engine spark timing (EST) signals, supplied by the ECU, to selectively couple the primary windings L1 and L2 to system ground through switches Q1 and Q2 respectively controlled by signals Igbt1 and Igbt2, respectively. Measured primary current Ip and secondary current Is are sent to control unit. Advantageously, the common energizing potential of the battery is coupled by way of an ignition switch M1 to the primary windings L1, L3 at the opposite end that the grounded one. Switch M1 is preferably a MOSFET transistor. A diode D3 or any other semiconductor switch (e.g. MOSFET) is coupled to transistor M1 so as to form a step-down converter. Control unit is enabled to switch off switch M1 by means of a signal FET. The diode D3 or any other semiconductor switch will be switched on when M1 is off and vice versa.

In prior art operation, the control circuit is operative to provide an extended continuous high-energy arc across the gapped electrodes. During a first step, switches M1, Q1 and Q2 are all switched on, so that the delivered energy of the power supply is stored in the magnetic circuit of both transformers (T1, T2). During a second step, both primary windings are switched off at the same time by means of switches Q1 and Q2. On the secondary side of the transformers a high voltage is induced and an ignition spark is created through the gapped electrodes of the spark plug. During a third step, after a minimum burn time wherein both transformers (T1, T2) are delivering energy, switch Q1 is switched on and switch Q2 is switched off (or vice versa). That means that the first transformer (L1, L2) stores energy into its magnetic circuit while the second transformer (L3, L4) delivers energy to spark plug (or vice versa). During a fourth step, when the primary current Ip increases over a limit (Ipmax), the control unit detects it and switches transistor M1 off. The stored energy in the transformer (L1, L2 or L3, L4) that is switched on (Q1, or Q2) impels a current over diode D3 (step-down topology), so that the transformer cannot go into the magnetic saturation, its energy being limited. Preferably, transistor M1 will be permanently switched on and off to hold the energy in the transformer on a constant level. During a fifth step, just after the secondary current Is falls short of a secondary current threshold level (Ismin) the switch Q1 is switched off and the switch Q2 is switched on (or vice versa). Then steps 3 to 5 will be iterated by sequentially switching on and off switches Q1 and Q2 as long as the control unit switches both switches Q1 and Q2 off.

Figures 2A, 2B, 2C:
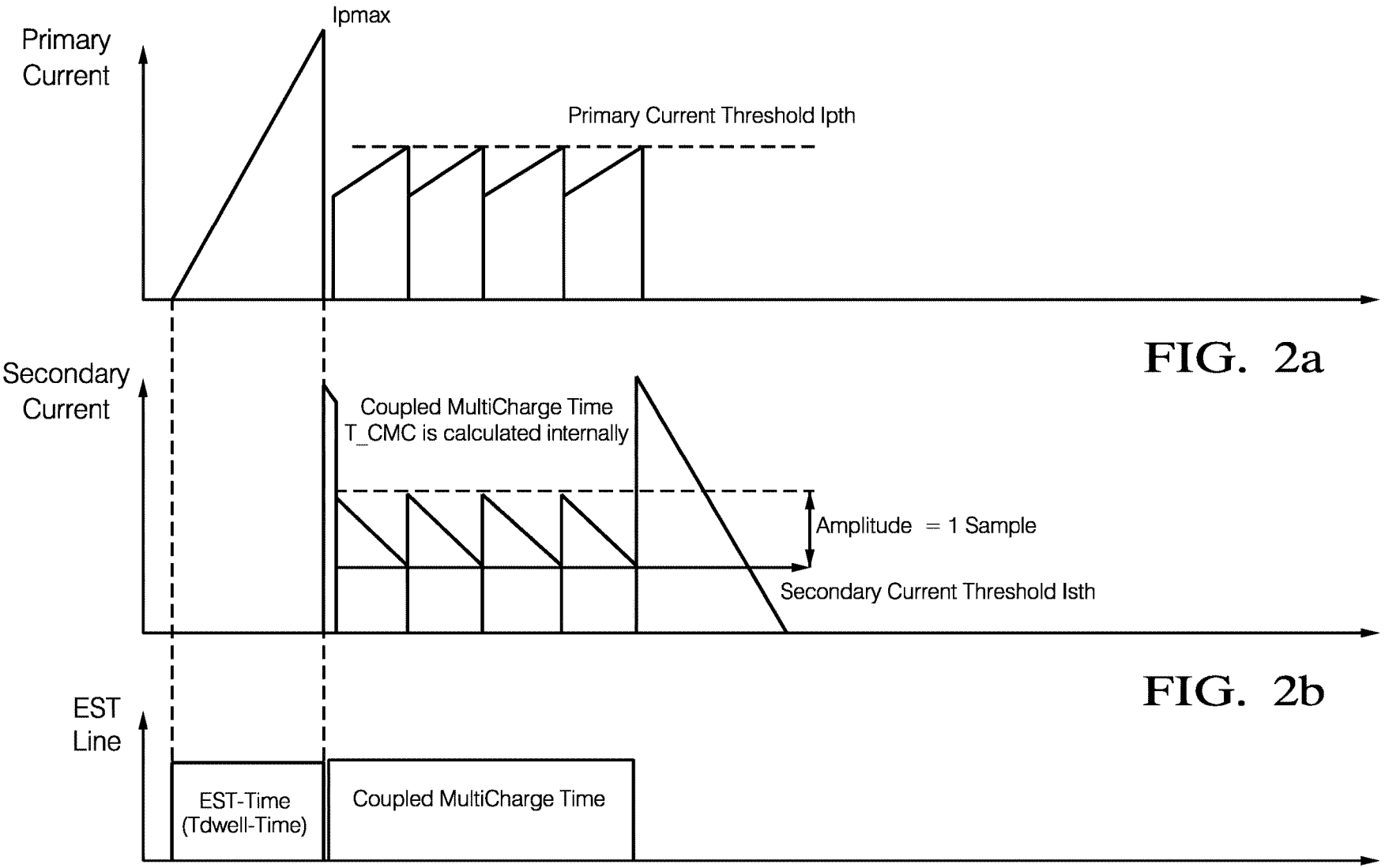
FIGS. 2*a*, 2*b*, and 2*c* illustrate a standard ignition cycle of the CMC-system indicating schematic current traces.

FIGS. 2*a*-2*c* show a timeline of ignition system current; FIG. 2*a* shows a trace representing primary current Ip along time. FIG. 2*b* shows the secondary current Is. FIG. 2*c* shows the signal on the EST line which is sent from the ECU to the ignition system control unit and which indicates ignition time. During step 1, i.e. M1, Q1 and Q2 switched on, the primary current Ip is increasing rapidly with the energy storage in the transformers. During step 2, i.e. Q1 and Q2 switched off, the secondary current Is is increasing and a high voltage is induced so as to create an ignition spark through the gapped electrodes of the spark plug. During step 3, i.e. Q1 and Q2 are switched on and off sequentially, so as to maintain the spark as well as the energy stored in the transformers. During step 4, comparison is made between primary current Ip and a limit Ipth. When Ip exceeds Ipth M1 is switched off, so that the "switched on" transformer cannot go into the magnetic saturation, by limiting its stored energy. The switch M1 is switched on and off in this way, that the primary current Ip is stable in a controlled range. During step 5, comparison is made between the secondary current Is and a secondary current threshold level Isth. If Is<Isth, Q1 is switched off and Q2 switched on (or vice versa). Then steps 3 to 5 will be iterated by sequentially switching on and off Q1 and Q2 as long as the control unit switches both Q1 and Q2 off. Because of the alternating charging and discharging of the two transformers the ignition system delivers a continuous ignition fire. The above describes the circuitry and operation of a prior art ignition system to provide a background to the current invention. In some aspects of the invention the above circuitry can be used. The invention provides various solutions to enhance performance and reduce spark-plug wear.

Figure 3:
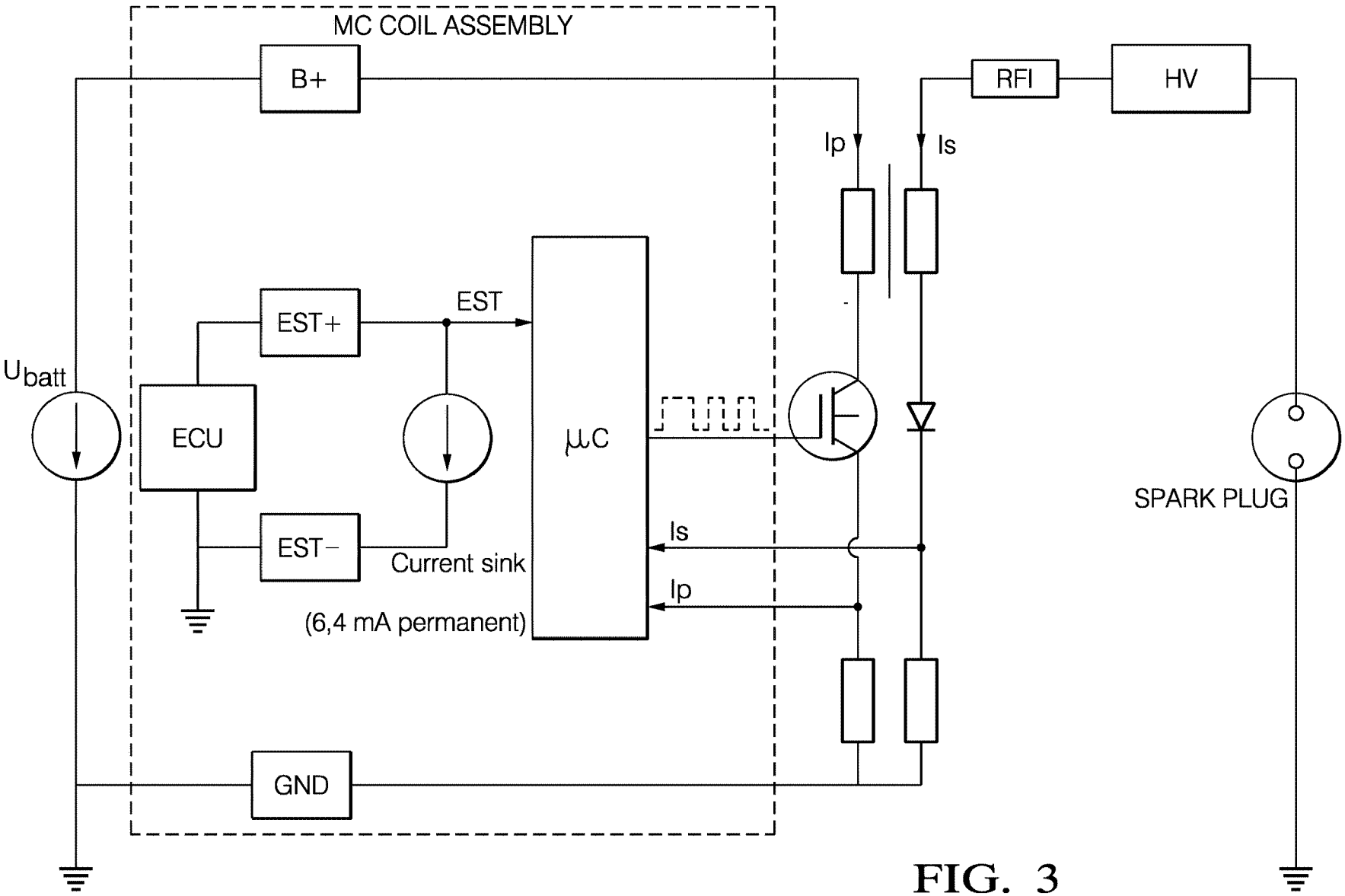
FIG. 3 illustrates an ignition system and its connectivity to a vehicle electronic control unit (ECU).

FIG. 3 shows the connectivity of the vehicle ECT to the spark plug control circuitry via an EST line, which is used according to one aspect in signalling i.e. sending via appropriate communications protocol, voltage or current parameters to the spark plug circuitry control unit which controls the ignition circuitry. The EST line typically provides the control unit with a pulse which indicates the dwell time to be implemented. The control unit of the coil is separate to the ECU and the EST-signal (engine spark time) is delivered by the ECU by a e.g. a Boolean signal—see FIG. 2*c*. Conventionally this controlled directly a switch/IGBT inside the ignition coil and in current systems this controls also the time of the burn time of the MultiCharge-cycle. In the figure is shown as system where there is only a single stage spark winding.

As mentioned, a problem with prior art systems is that there is spark plug wear. The inventors have determined that this can be reduced by improving the control of current and voltage parameters of primary and secondary coil(s), and furthermore in certain aspects of the invention, such parameters can be set by sending data on the EST line. Thus in a refined aspect, the invention provides a communication protocol to control parameters such as those relating to the current or voltages in the primary and/or secondary coils.

DETAILED DESCRIPTION OF THE INVENTION

Example 1

Control of Parameters Such as Primary Current Threshold in CMC Mode

As mentioned, a problem with prior art systems is that there is spark plug wear. The inventors have determined that this can be reduced by controlling various current and voltage parameters of primary and secondary coil(s), and furthermore in certain parameters can be better controlled by the ECU and sent to the control unit set by sending data, such as appropriate current/voltage parameters and their thresholds on the EST line. Thus in one aspect therefore, the invention provides a communication protocol to control parameters such as those relating to the current or voltages in the primary and/or secondary coils. As mentioned FIGS. 2*a*-2*c* show the current a primary coil and secondary coil over a complete ignition cycle.

Figure 4:
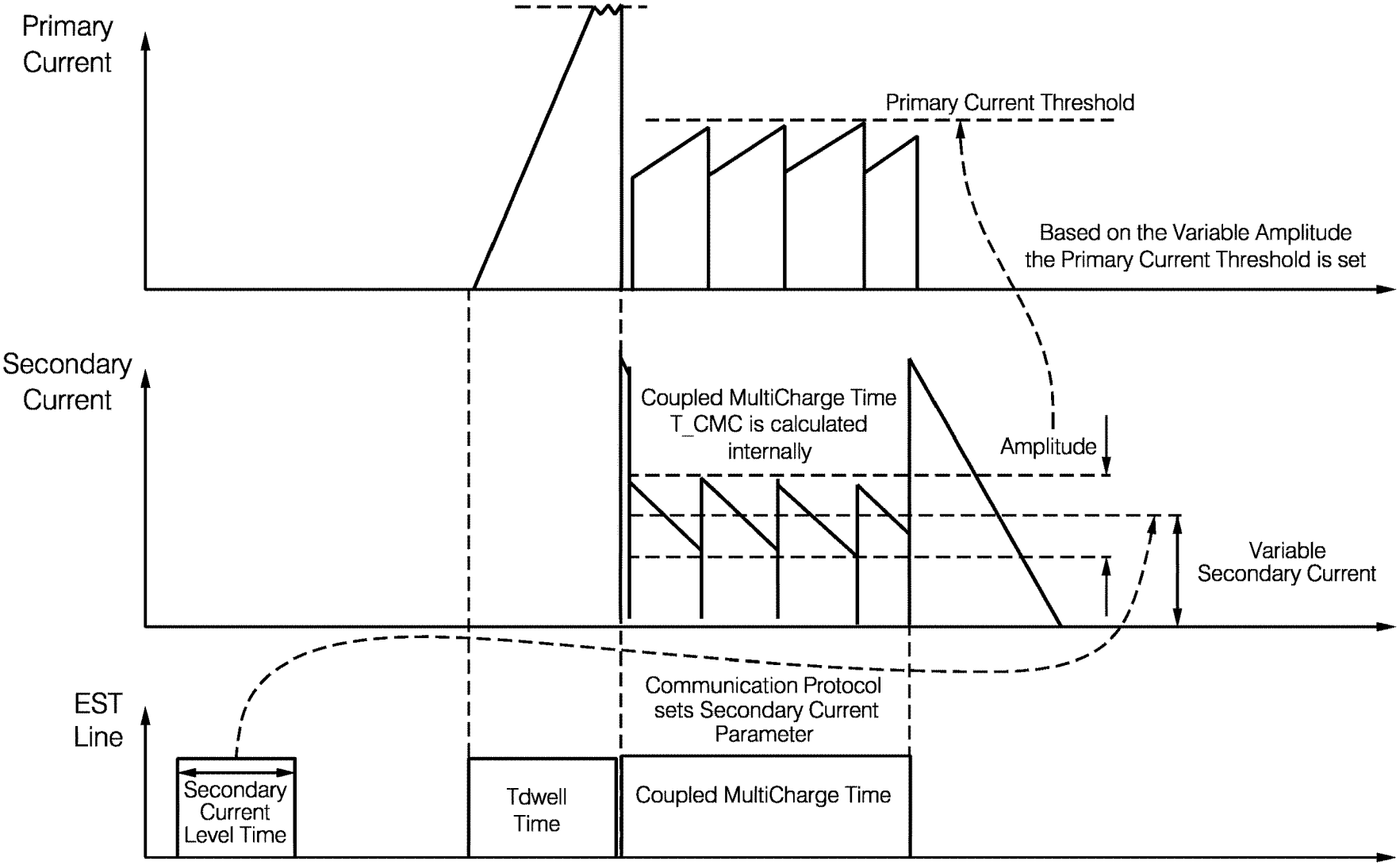
FIG. 4 illustrates a communication protocol according to one aspect of the invention which can be used to control ignition systems.

FIG. 4 illustrates a communication protocol according to one example which can be used to control ignition systems; particularly the primary and secondary current(s) and/or voltage(s). Such methods may be used in conjunction with the circuitry shown in FIG. 1*a*, though the methodology is not limited to such circuitry, and some aspects are applicable to ignition systems where there is only one coil stage.

As mentioned FIGS. 2*a* and *b* shows the current a primary coil and secondary coil over a complete ignition cycle. FIG. 2*c* shows the EST line which is used to provide a communications protocol to a control unit which controls the ignition circuitry, such as that of FIG. 1. At the start of the ignition cycle, the current in a/the primary coil is ramped up to reach a maximum primary current peak. The value of this peak will also affect the maximum secondary breakdown voltage. At the end of this stage the current in the primary coil is discharged causing a current to develop rapidly in the secondary coil. After this, in multistage systems in each coil stage, the charging/discharging cycle is repeated multiple times, alternatively by each coil stage, thus providing a continuous spark. At the end of the ignition stage it is to be noted that high currents may develop in the secondary coils.

According to one example a (first) communication pulse 1 is provided on the EST line, the duration of which indicates to the control unit the maximum primary current (threshold) in the Coupled-MultiCharge-Mode; what this parameter should be set at. Thus the EST line is used to forward parameters other than dwell or CMC time, and can include units other than time and be representative of current or voltages (e.g. thresholds for comparison) during any stage of operation.

The control of this current level may be implemented by appropriate control by the control unit of the step-down converter. Thus, based on the length of the first communication pulse, the primary current may be limited by appropriate operation of the step-down-converter. If the primary current reaches this level, current will be limited by the step down converter. Thus the control unit will accordingly control of the step down converter stage by e.g. appropriately switching on/off the FET M1. According to aspects of the invention, the control unit has means to compare the primary or secondary currents with e.g. (threshold) parameters sent along the EST line. So in other words the step-down-converter can be used to limit the primary current to a desired value Ipthmax and to hold it constant at this specified level. Traditionally this parameter may be stored in the control unit. However an advantage of this aspect of the invention is that Ipthmax and or Ipthmin can be set by the ECU, and using appropriate communication protocol can be sent to the control unit.

As will be explained hereinafter, other parameters such as Ipmax (that is the max peak value of primary current as well as Ipth (the threshold e.g. max primary current in CMC operation) can be adapted and set by the ECU, dependent in what state of the ignition cycle the system is. See FIG. 4.

Figure 5:
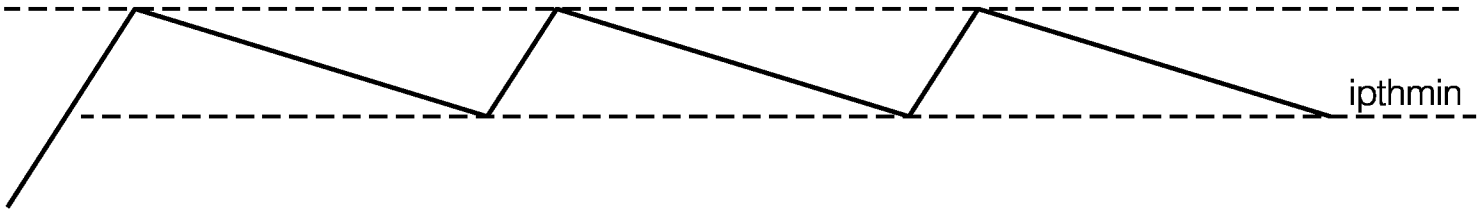
FIG. 5 shows the results of operation of the step down converter in such control.

As mentioned, during operation of appropriate phases of operation of the system, the value of the primary current can be compared with the thresholds by the control unit. In order to control the respective primary current level, the step down converter is appropriately controlled e.g. by pulsing switch M1, i.e. switching on and off. In this way the average of the primary current is controlled to be inside the required range. In a specific example, the primary current Ip may be measured during the step down cycle and switching M1 on and off as follows: switching M1, the current flows over L1, Q1, R1 and D3 and is decreasing. The control unit monitors the voltage. After the primary current reaches a level Ipthmin, M1 will be switched on again. The parameter Ipthmin may be set by the ECU or the control unit. Alternatively it may be calculated by either based on Ipthmax: Ipthmin=Ipthmax−Ipthamp. Ipthamp again may be set or stored as a fixed value in the CU in a range of ~0.2 A-1 A. M1 is switched on as long as the primary current reaches the upper level Ipthmax again. Then steps above are repeated as long the primary current needs to be limited. The controlled operation is illustrated in FIG. 5.

Such methods may be used in conjunction with the circuitry shown in FIG. 1, though the methodology is not limited to such circuitry, and some aspects are applicable to ignition systems where there is only one coil stage. Furthermore although the above refers to sending the parameter of maximum primary current (threshold) in the Coupled-MultiCharge-Mode, aspect of the invention include sending any appropriate current or voltage parameter from the ECU to the spark plug control unit; some of which will be explained in more detail hereinafter. The important point in this aspect is that the EST line is used other than for sending CMC and dwell times to the control unit. In preferred embodiments as mentioned the levels of current and voltage parameters are indicated by the duration of the pulses. However the levels may be signaled by other methods such as the number of very short pulses e.g. within a set time being indicative of the levels.

According to alternative embodiments, the pulse sent along the EST line from the ECU to the control unit may indicate secondary current parameters (e.g. limits or thresholds for comparison with measured values), or any other parameter of primary or secondary coil current/voltage, as will be explained below.

Example 2

Control of Secondary Currents Isth and Isamp

According to a further aspect of the invention the parameters of secondary currents are controlled, e.g. during the CMC phase, by similar methodology.

In one aspect parameters of the secondary current threshold Isth and the secondary current amplitude Isamp are sent using a communication protocol from the ECU to the control unit. By appropriate control of these parameters, it is possible to control the output power of the system. These parameters may be compared with measured values by the ECU and used to appropriately control the operation of the coil stages.

In a further embodiment, based on the two desired variables of Isth and Isamp, the maximum primary current threshold is calculated: Ipth (Ipth=(Isth+Isamp)*ue), where ue is the transformer ratio. The parameter Isth is adapted dependent on the burn voltage of the spark plug, but before Isth is set by the communication of the ECU—this is a preferred wanted value and the calculation of Ipth is done based on this initial set value. If the load (burn-voltage) is too high then the secondary current will be ramped down; thus this may involve setting adaptively said second predetermined current threshold (Ismin) to the level of energy stored in the transformer that is switched off. How is it implemented, each time when the switches are toggling to their other state, the actual primary current Ip is measured and based on this value the threshold is set adaptively: Isth=Ip/ue−Isamp, that means Isth is only ramped down if the measured value of ip<Ipth. Against this, the value for the primary current threshold Ipth is set during the entire ignition cycle on the same level.

Example 3

Control of Maximum Primary Current Peak Ipmax

Figure 6:
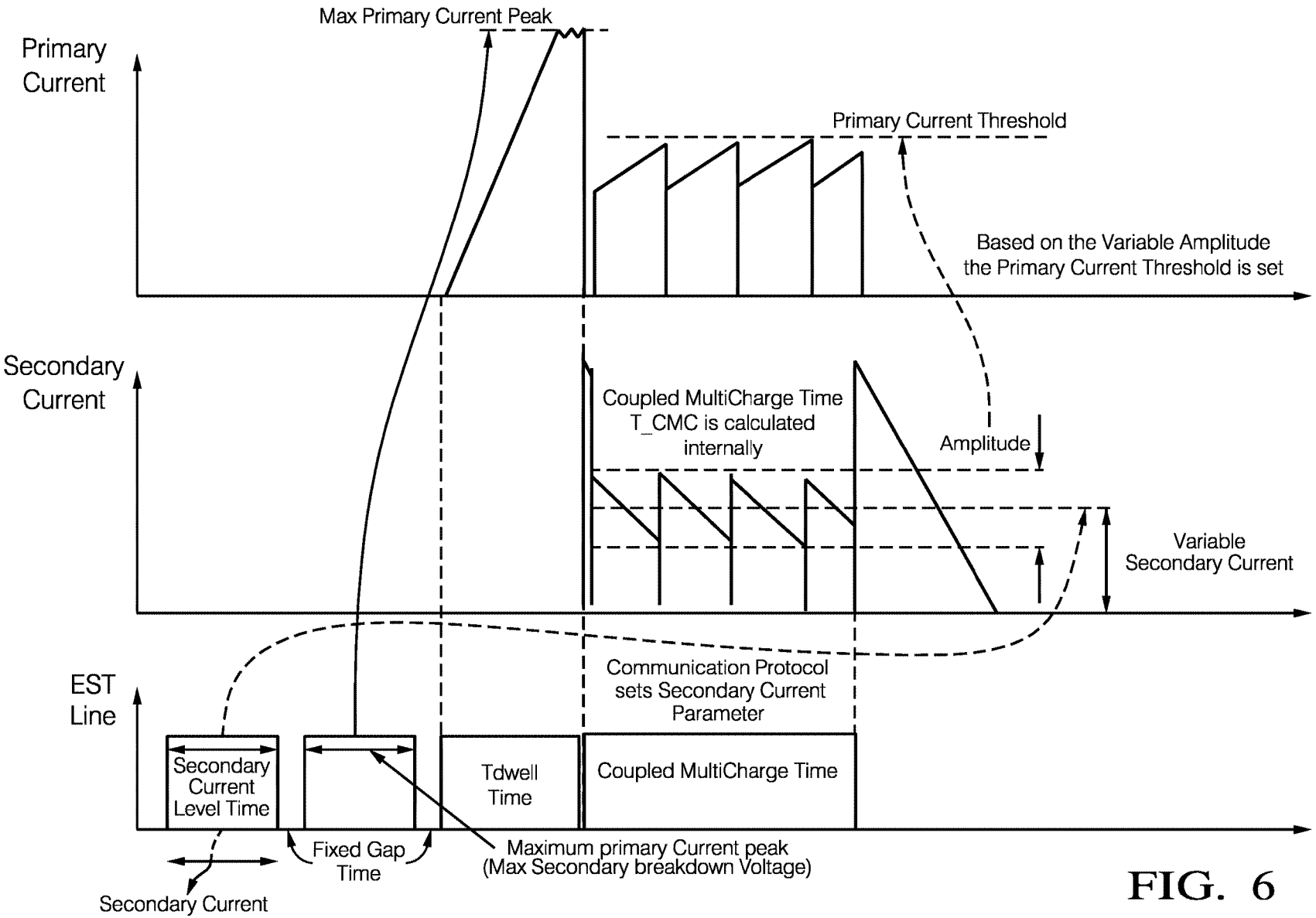
FIG. 6 shows a communication protocol according to one aspect of the invention which can be used to control ignition systems including a further pulse.

The variable Ipmax is the maximum primary current after the initial charge of the system. According to one aspect this parameter also be controlled by comparing to a threshold value(s). The threshold values may be either stored in the control unit or sent along the EST lines in a similar fashion to the max primary current (threshold during CMC) stage. Again the value of Ip can be measured and determine against a threshold Ipmax. So to recap this value is stored in the control unit, or can be transmitted to the control unit from the ECU along the EST line. When the primary current Ip exceeds the threshold Ipmax then the step down converter will hold the primary current Ip on the specified level defined by Ipmax. The current is similar to the current in FIG. 5, so it has a small hysteresis. The control operation of the step down converter is similar to that of example 1. FIG. 6 shows a communication protocol where there is a second pulse 2; the second pulse length indicates the max primary current peak. Of course the max primary current peak can be controlled on its own by means of a single pulse i.e. not in conjunction with any other parameter.

Again similar to the further embodiment of Example 2, in a further embodiment, based on the two desired variables of Isth and Isamp, the maximum primary current threshold is calculated: Ipth (Ipth=(Isth+Isamp)*ue). The parameter Isth is adapted dependent on the burn voltage of the spark plug, but before Isth is set by the communication of the ECU—this is a preferred wanted value and the calculation of Ipth is done based on this initial set value. If the load (burn-voltage) is too high then the secondary current will be ramped down; thus this may involve setting adaptively said second predetermined current threshold (Ismin) to the level of energy stored in the transformer that is switched off. How is it implemented, each time when the switches are toggling to their other state, the actual primary current Ip is measured and based on this value the threshold is set adaptively: Isth=Ip/ue−Isamp, that means Isth is only ramped down if the measured value of ip<Ipth. Against this, the value for the primary current threshold Ipth is set during the entire ignition cycle on the same level.

Example 4

Voltage Measurement Method

Figure 11:
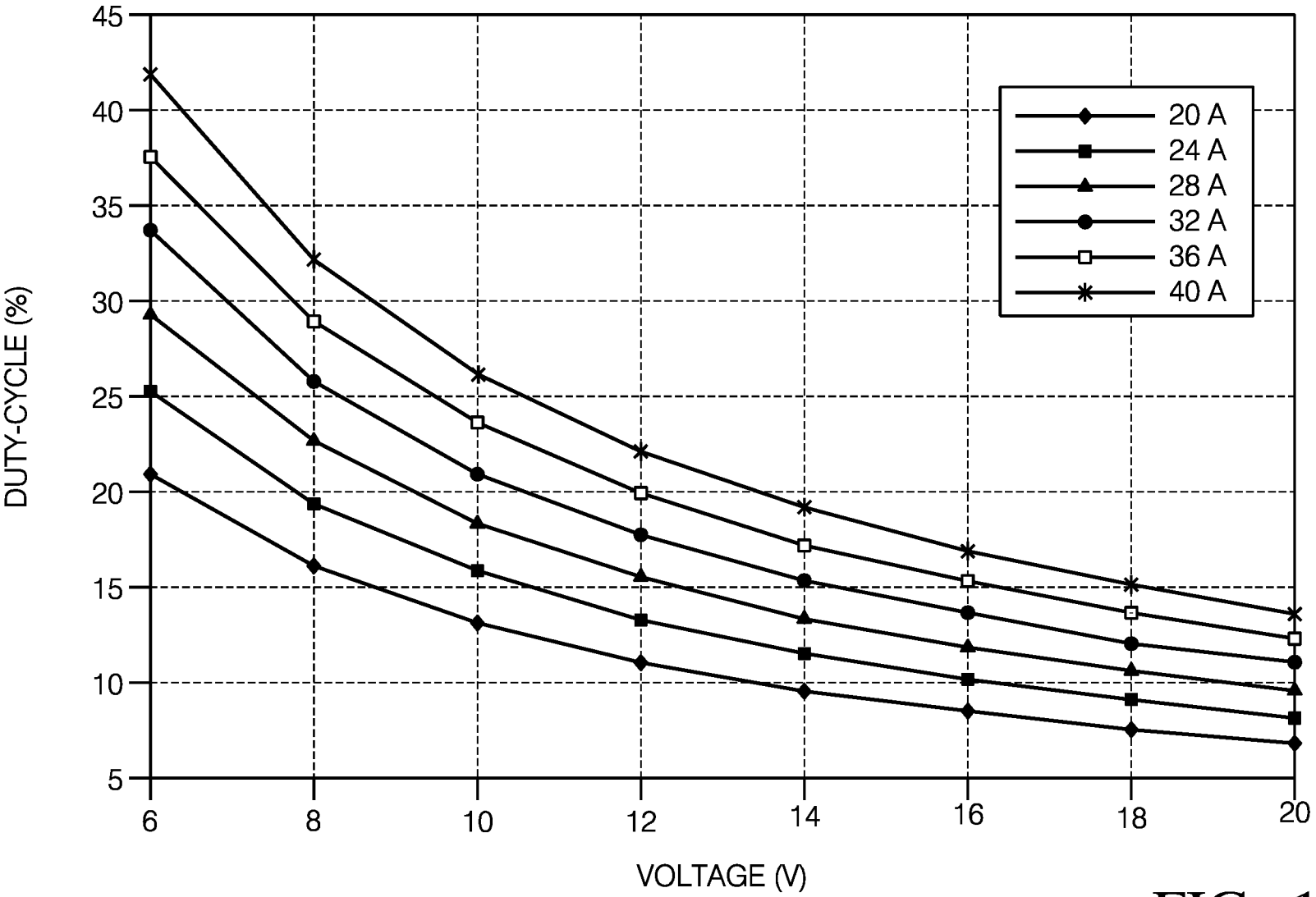
FIG. 11 shows the relationship between the duty cycle, battery voltage and maximum primary current switching threshold in step-down-operation.

A problem of the Example 1 above is the limitation of the hardware to control the small hysteresis (accuracy of the hardware and noise of the measured primary current Ip). Therefore in a preferred method the primary voltage (i.e. that of the battery Ub) is measured and sets the pulse width (i.e. the duty cycle) of the PWM-signal of the step-down-converter dependent on the battery voltage and the maximum primary current threshold Duty-Cycle=f(Ub,Ipthmax) where Ub is the battery voltage. The duty-cycle m is defined as: m=Ton/(Ton+Toff), whereas Ton is the on-time of M1 and Toff is the off-time of M1. Ton+Toff=const., that means it is a pulse width modulated signal. One way to find the right value of m=f(Ub,Tpthmax) is by a simulation (see FIG. 11). Here the PID controller controls the primary current to the wanted value Ipthmax. The controlled system represents the ignition coil. For each value of Ub and Ipthmax one value for m can be observed (truth table, as it was shown in the last figure). FIG. 11 shows the relationship between the duty cycle, Ub and Ipthmax. The points between the data points can be interpolated linear. The duty cycle can be set based on a lookup table that depends on Ub and Ipthmax. It would be clear to the person skilled in the art how such a duty cycle for a lookup can be calculated, with the help of a e.g. a simulation based on a specific transformer geometry that includes the specific inductance and resistance of the coil and based on a fixed frequency for the PWM converter.

Figure 7:
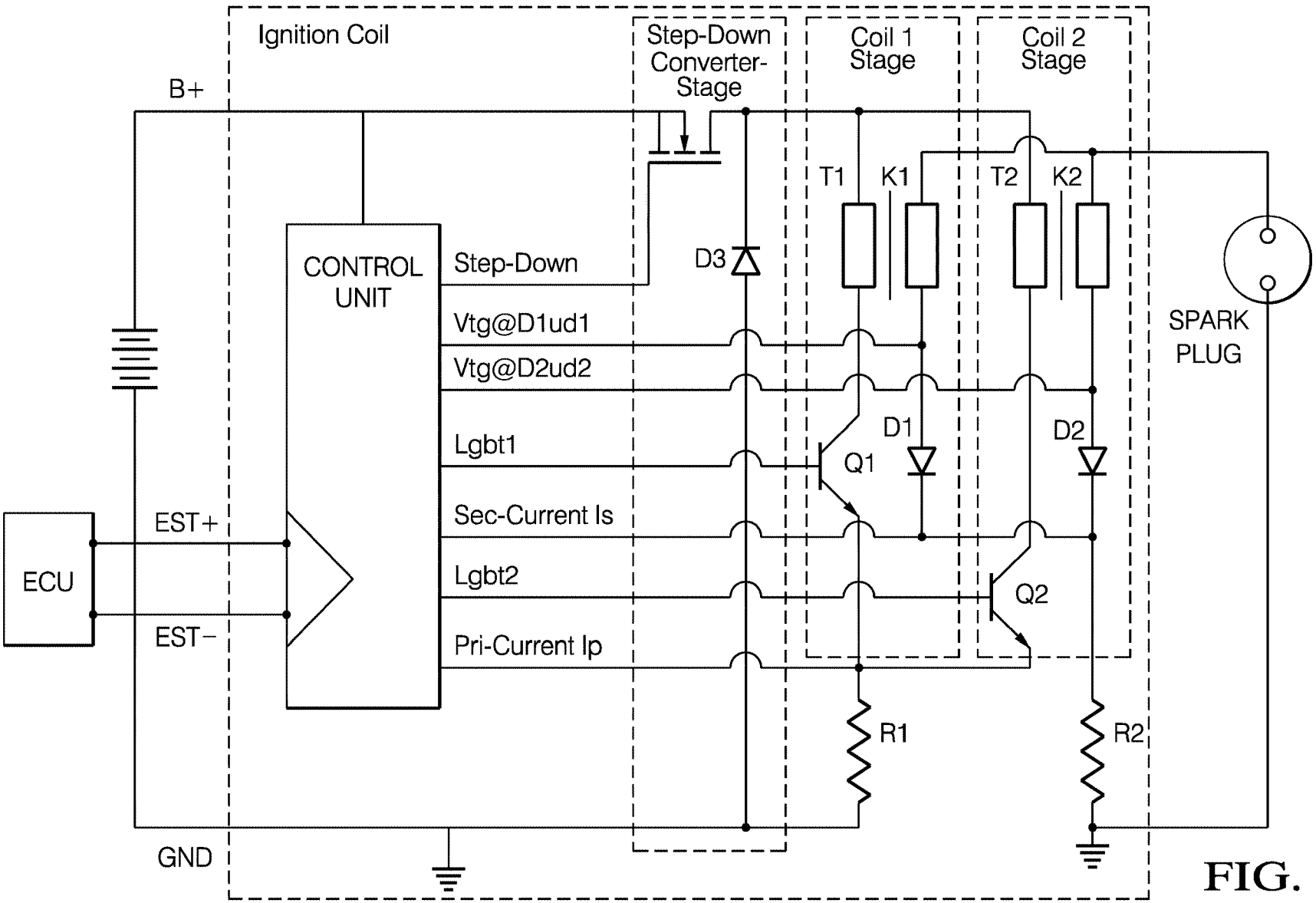
FIG. 7 shows a schematic circuit diagram of an ignition system according to a further aspect of the invention.

In order to provide this methodology additional circuitry is provided. FIG. 7 shows the circuit that is used to control the system; it is similar to that of FIG. 1 but includes mean to measure the voltage at the high voltage HV-diodes (D1 and D2). The supply voltage (Ubat) can additionally be measured. The system is controlled by measuring the primary current Ip, the secondary current Is and the voltage D1, D2 at the diodes. Dependent on these measured voltages and the supply voltage Ubat, the duty-cycle of the PWM-signal for the Step-Down-Converter is appropriately controlled. The primary and secondary currents can be measured by a shunt and used to obtain voltages. Dependent on the resistance of the shunts and with this of the amplitudes of the measured values it can be necessary to amplify the values. This can be realized by the use of an operational amplifier. The high voltages at the diodes are reduced by a voltage divider to the voltage range of the control unit—the voltage divider is in a range of ~1000-2000. Also the supply voltage Ubat is measured by the use of a voltage divider—here the voltage divider is in a range of ~2-20.

Furthermore the circuitry in FIG. 7 can be used in general to measure the voltages at the secondary stages and compare these with e.g. thresholds or values which may be stored in the control unit. Alternatively the EST line may be used to signal any threshold or other voltage values determined by the ECU.

According to various aspects of the invention, the current or voltage parameters with respect to one or more coil stages and for any phase may be sent according to an appropriate protocol from the ECU to the control unit. According to aspects this parameters are indicated by the duration of pulses sent to the control unit from the ECU. In a simple embodiment just one parameter is sent to the control unit a single pulse is sent on the EST line. However where more than one parameter is sent form the ECU, more than one pulse may be sent. One or more of the following parameters may be sent: Maximum primary current peak Ipmax; Secondary current switching threshold in CMC-Mode Isth; Secondary current switching amplitude in CMC-Mode Isamp, secondary or primary voltages.

Diode Protection

In yet a further aspect the invention provides various solutions to enhance performance and reduce spark-plug wear and in particular protect the diodes D1 and D2. This is because a further problem with prior art ignition systems is that diodes in the coil stages can suffer from a high voltage which leads to damage. In one aspect the invention, protection is provided for the diodes. According to a general aspect, the voltage at the diodes is detected/measured and consequent to the measured voltage, appropriate protection is implemented. For example, if the voltage at the diodes reaches a specific threshold, the control unit detects this voltage and will protect the diodes from too high voltages.

The FIG. 7 circuitry described above can be used to provide such control. So again compared with the FIG. 1 circuitry the voltage at the high voltage diodes (D1 and D2) is measured by providing lines to the control unit. The control unit includes means to measure these voltages and where appropriate, compare with thresholds. Thus FIG. 7 also shows an example of the circuitry used to implement this aspect with a multi-stage system; however aspects of the invention can be applied to spark plug control systems having just one stage; FIG. 7 shows an example of the circuitry used to implement this aspect with a multi-stage system. This figure shows circuitry which thus includes two connections (lines) which are connected at one point between the secondary coil stage and the respective diodes, and at the other are connected to the control unit. These lines are used to feed the voltage into the control unit which can measure the voltages input to it, so as to detect/measure the voltage at the two diodes.

In one embodiment the control unit determines if either, or both of these voltages, are above a threshold and if so implement protection strategies.

In order to implement control either the down converter and/or either or both of the switches Q1 and Q2 are controlled.

In a particular protection strategy, for use with systems with two coil stages, protection is implemented by switching both D1 and D2 on by switching Q1 and Q2 off. Then as a result of switching Q1,Q2, the diodes are switched on in a forward direction.

In an alternative, strategy, protection is provided by switching both Q1 and Q2 on. In this instance, the voltage at the diodes is then limited to the so called "Make-Voltage" (UM) where UM=ue*Ub (ue=transfer ratio of the transformer, Ub=Battery-Voltage). Thus in some aspects, the battery voltage is also determined or estimated.

In a twin/multistage system, the CMC-system is using two transformers to deliver energy to the secondary side. The critical situation for the diodes occurs ones after the initial charge respectively during the initial breakdown of both stages. Here the diodes are protected by switching both diodes into forward direction (Q1 and Q2 are off).

Preferably the system is controlled in this way (switching first stage 1 off and then stage 2) as otherwise the diodes would need to withstand the whole breakdown voltage (~40 kV and more). After the initial breakdown the burn voltage at the spark plug decreases to values of about 1000 V (Uburn~1000V). At this time we are starting to toggle the stages 1 and 2. The diode that is not switched on needs to withstand the burn voltage plus the make voltage; that is to say Ubreakmin=Uburn+ue*Ub. When the burn voltage reaches a special threshold Uburnmax; the diodes are protected as described above. The diode in a conventional ignition system (MultiCharge or SingleCharge) doesn't see a high voltage when they are firing, because it is switched on in forward direction. The critical situation for the diode occurs during the so called open load operation (no spark plug mounted at the output) and when the ignition fire is blown out initiated by turbulences in the engine.

In one embodiment the control unit determines if either, or both of these voltages, are above a threshold and if so implement protection strategies.

In a first protection strategy, protection is implemented by switching both D1 and D2 on by switching Q1 and Q2 off. Then as a result of this the diodes are switched on in a forward direction.

In an alternative, strategy, protection is provided by switching both Q1 and Q2 on. In this instance, the voltage at the diodes is then limited to the so called "Make-Voltage" (UM) where UM=ue*Ub (ue=transfer ratio of the transformer, Ub=Battery-Voltage). Q1 and Q2 are switched on until the maximum primary current Ipmax is reached and then the CMC algorithm starts from the beginning by alternating switch Q1 and Q2. Corresponding to their last state in the CMC-cycle before the high voltage at the diodes was detected; the states of Q1 and Q2 will be negated.

In advanced embodiments, the currents in the secondary coil stage(s) can be used in conjunction with the measured voltages by the control unit to control the step-down converter and/or either or both of the switches Q1 and Q2.

Reducing Secondary Current Peak at the End of the CMC Phase

Typically in CMC-ignition systems, a high secondary current peak is developed in secondary coil(s) at the end of the ignition cycle as shown in FIG. 2*b*. This will increase spark plug wear. In order to avoid this, in one aspect, various methods according to the invention are used to eliminate the high current peak.

Figure 8A:
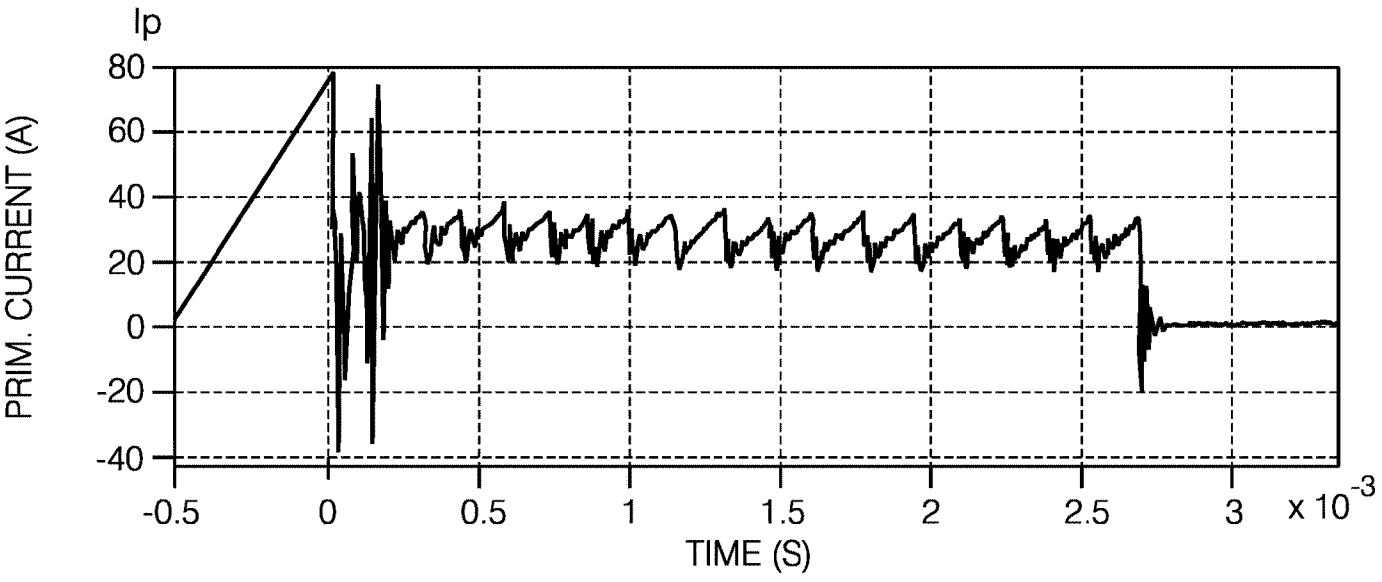
FIGS. 8*a* and 8*b* show the results of operation of the down converter to reduce secondary current peak.
Figure 8B:
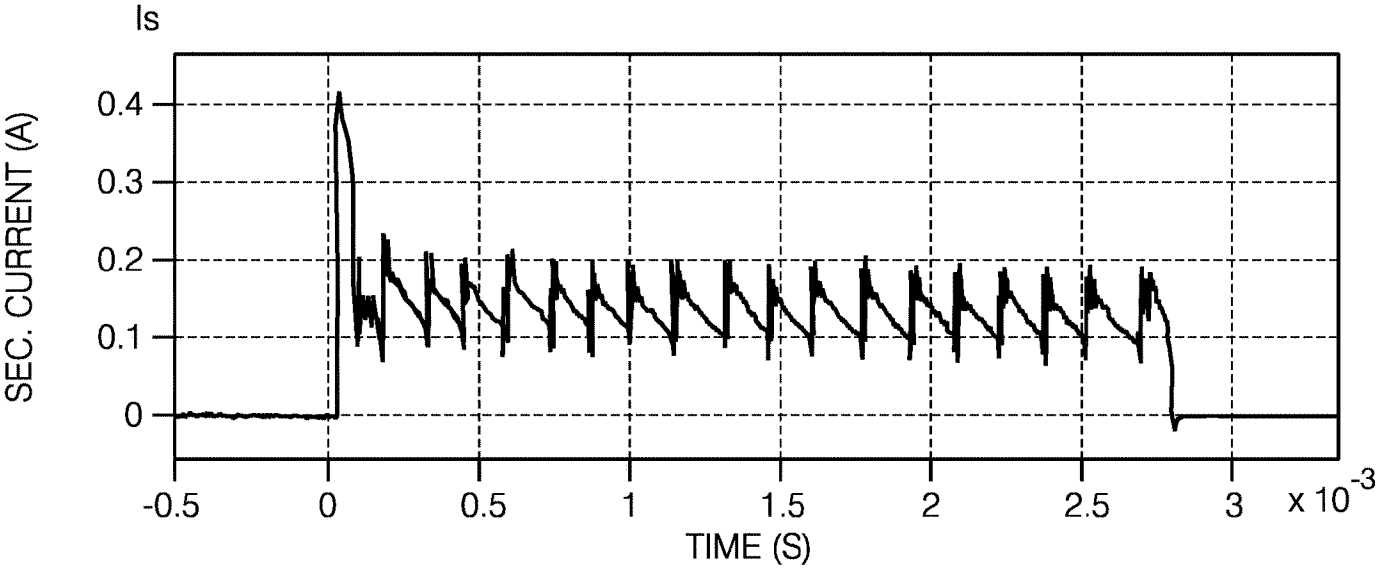

In a first example, a solution is provided by switching on the step-down converter, by switching on M1, as well as switching on Q1 and Q2 when the Coupled Multi-Charge time has expired. This however has the disadvantage in that all the energy will be dissipated to the primary side of the coil and will increase the heat losses inside the coil. This example is shown in FIGS. 8*a* and 8*b*.

In a second embodiment, the methodology provides an alternative method which involves down-ramping of the secondary current at the end of the Coupled-Multi-Charge-Time. This is again can be implemented using the step-down-converter.

Figure 9:
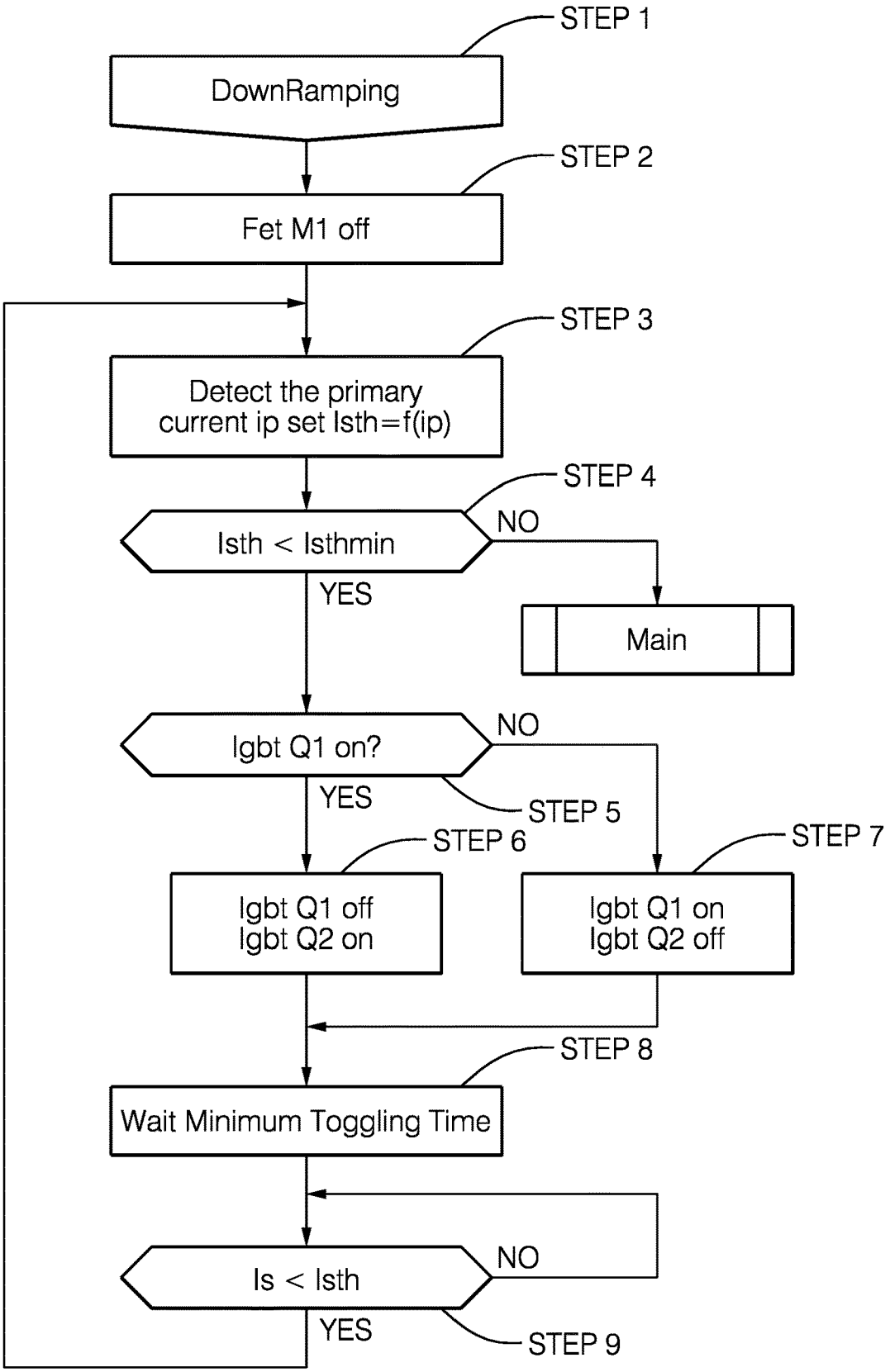
FIG. 9 shows a flow chart illustrating a down-ramping algorithm according to one aspect.

The implementation of the down-ramping algorithm is shown in a flow chart in FIG. 9:

In Step 1 the down ramping is initiated after the CMC-time is expired. One of the switches Q1/2 is on the other is off. In Step 2, M1 is switched off, so that the circuit is disconnected from the battery. In Step S3, the primary current is determined and a secondary current threshold will be set accordingly to the actual primary current (Isth=f(ip)=Ip/ue—Isamprd). The parameter Isamprd can be a fixed value, stored inside the control unit, this parameter is typically in a range of 20-80 mA. In Step 4 the secondary current threshold value is compared with a minimum value Isthmin. This value Isthmin may be stored in the spark plug control unit or sent on the EST line. If the secondary current threshold is too low (Isth<Isthmin (~10 mA)) then the down ramping algorithm will finish, M1 is off and Q1 and Q2 on.

In step 5 it is determined whether switch Q1 is on. If so at step 6 it is made sure that Q1 is switched off and Q2 is switched on. If not at step S7 it is made sure that Q1 is switched on and Q2 is switched off. Thus accordingly to their actual switching-states of Q1 and Q2, their states will be negated, meaning switch Q1 is switched off and Q2 on or vice versa.

In step S8 there may be an optional step of waiting for a minimum toggling time. In step S9, the measured secondary current is compared with a threshold Isth. When the measured value is less than the threshold Isth the method returns to step 3.

In this case the energy will partly disappear to the spark plug/gap and to the primary side of the coil without having such a high current peak and with this a high spark-plug-wear.

A lower value of Isamprd will result in a faster toggling frequency of Q1 and Q2. This parameter may be adapted experimentally dependent on the secondary inductance of the transformer.

During the described down-ramping algorithm the voltage at the HV-diodes can be measured. In order to provide this methodology additional circuitry is provided. FIG. 7 shows the circuit that is used to control the system; it is similar to that of FIG. 1 but includes means to measure the voltage at the high voltage HV-diodes (D1 and D2). The supply voltage (Ubat) can additionally be measured. The system is controlled by measuring the primary current Ip, the secondary current Is and the voltage D1, D2 at the diodes. If either of the voltages is too high (e.g. compared with a threshold—similar to the diode-protection embodiment) Q1, Q2 will be switched on and M1 off, that means the energy will be dissipated to the primary side.

Figure 10A:
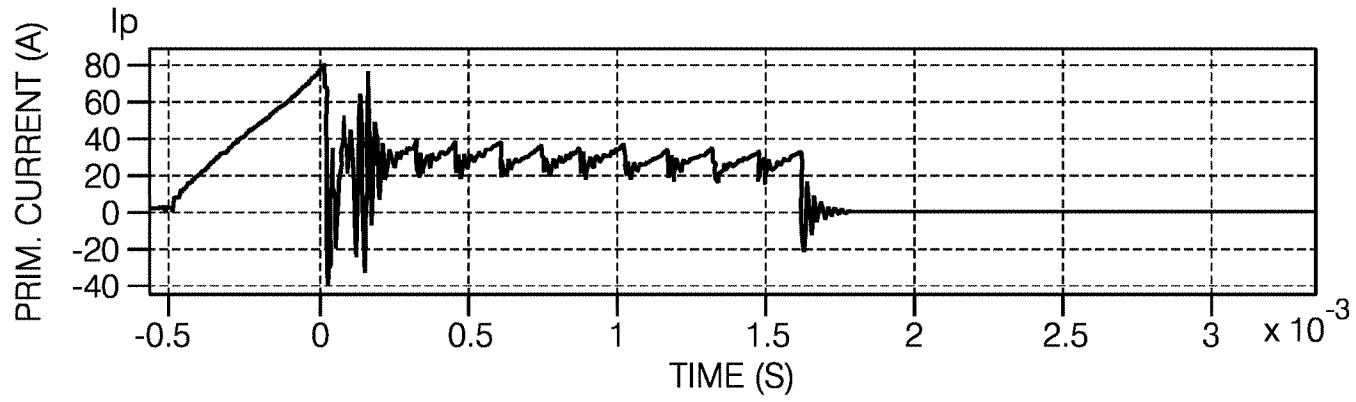
FIGS. 10*a*, 10*b*, and 10*c* show traces of currents where the algorithm of FIG. 9 is implemented.
Figure 10B:
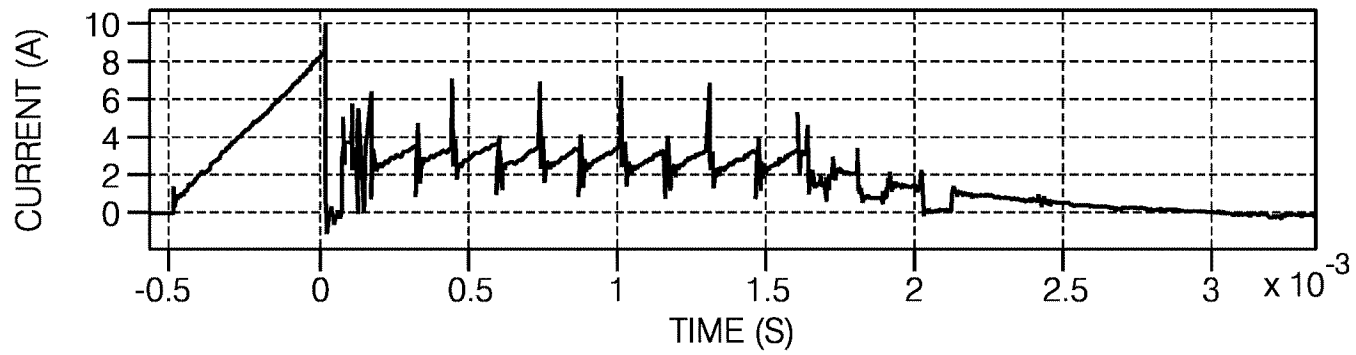
Figure 10C:
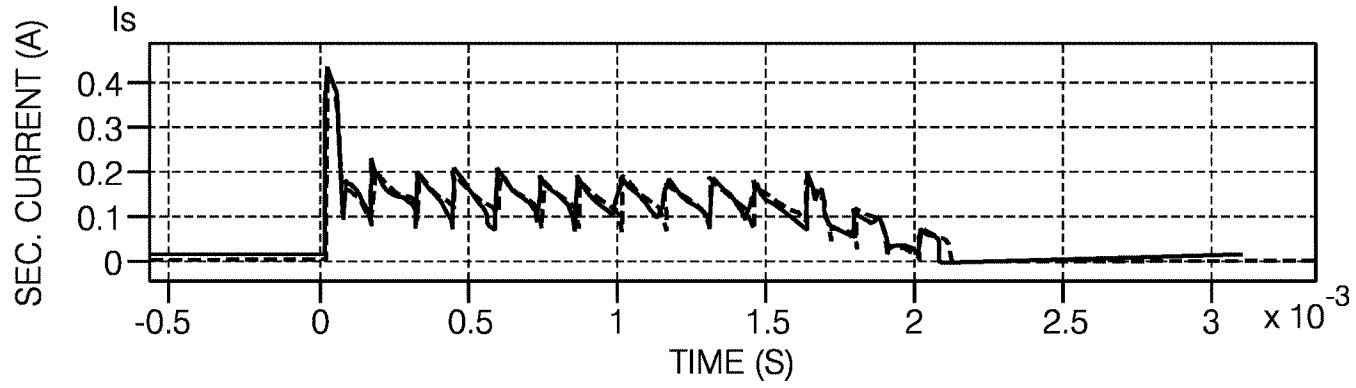

FIGS. 10*a*-10*c* show traces of primary and secondary currents where the algorithm of FIG. 9 is implemented. The internal primary current is the current measured at the shunt R1 and the primary current is measured here before the switch M1.

The invention claimed is:

1. A method of controlling an ignition system, said ignition system including a spark plug control unit adapted to control at least two coil stages so as to successively energise and de-energise said at least two coil stages to provide a current to a spark plug, including two stages comprising a first transformer including a first primary winding inductively coupled to a first secondary winding; a second transformer including a second primary winding inductively coupled to a second secondary winding; said spark plug control unit enabled to simultaneously energize and deenergize said first primary winding and said second primary winding by simultaneously switching on and off two corresponding switches to sequentially energize and de-energize said first primary winding and said second primary winding by sequentially switching on and off both of said two corresponding switches to maintain a continuous ignition fire, and includes a step-down converter stage located between said spark plug control unit and said at least two coil stages, said step-down converter including a switch and a diode, said spark plug control unit being enabled to switch off said switch, wherein the method provides control to limit a secondary current peak at the end of a Coupled Multi-Charge period, comprising the steps of, at the end of the Coupled Multi-Charge period:

i) switching off said switch which allows said primary current to fall to zero; and ii) toggling said two corresponding switches after switching off said switch in step i) and while said switch remains off.

2. A method as claimed in claim 1 further comprising:

iii) measuring the primary current after step i), wherein step ii) is implemented dependent on the measured primary current.

3. A method as claimed in claim 2 further comprising:

iv) measuring a secondary current after step ii) and comparing said secondary current with a threshold; and vii) when it is determined said secondary current is below said threshold, repeating steps ii) to iii).

4. A method as claimed in claim 2 further comprising waiting for a minimum time between said toggling.

5. A method as claimed in claim 4 wherein step iii) comprises:

a) setting a secondary current threshold value dependent on said measured primary current;

b) comparing said secondary current threshold value with a minimum value, and if said secondary current threshold value is above said minimum value, toggling said two corresponding switches.

6. A method as claimed in claim 2 wherein a secondary current threshold is a function of said measured primary current, a battery voltage, and a secondary current amplitude during a down ramping cycle.

7. A method as claimed in claim 6 wherein said secondary current amplitude during the down ramping cycle is set and stored in the spark plug control unit.

8. A method as claimed in claim 6 wherein said secondary current threshold, Isth, is based on the equation: said secondary current threshold=a measured secondary current/a transformer ratio the down ramping cycle.

9. A method as claimed in claim 1 wherein voltage on a low side of one or more of said at least two coil stages is determined, compared with a threshold, and if said voltage on said low side of said one or more of said at least two coil stages is above said threshold, switching said switch off and switching both of said two corresponding switches on.

10. A method as claimed in claim 1 including the step of measuring secondary voltages, comparing the secondary voltages with a threshold and if any of the secondary voltages are above the threshold, controlling the switching of at least one of said switch and said two corresponding switches.

11. A method of controlling an ignition system, said ignition system including a spark plug control unit adapted to control at least two coil stages so as to successively energise and de-energise said at least two coil stages to provide a current to a spark plug, including two stages comprising a first transformer including a first primary winding inductively coupled to a first secondary winding; a second transformer including a second primary winding inductively coupled to a second secondary winding; said spark plug control unit enabled to simultaneously energize and deenergize said first primary winding and said second primary winding by simultaneously switching on and off two corresponding switches to sequentially energize and de-energize said first primary winding and said second primary winding by sequentially switching on and off both of said two corresponding switches to maintain a continuous ignition fire, and includes a step-down converter stage located between said spark plug control unit and said at least two coil stages, said step-down converter including a switch and a diode, said spark plug control unit being enabled to switch off said switch, wherein the method provides control to limit a secondary current peak at the end of a Coupled Multi-Charge period, comprising the steps of, at the end of the Coupled Multi-Charge period:

i) allowing said Coupled Multi-Charge period to expire;

ii) switching off said switch after step i) which allows said primary current to fall to zero; and iii) toggling said two corresponding switches after switching off said switch in step ii) and while said switch remains off.

* * * * *